US009218777B2

(12) United States Patent
Yao et al.

(10) Patent No.: US 9,218,777 B2
(45) Date of Patent: Dec. 22, 2015

(54) ARRAY SUBSTRATE AND THE LIQUID CRYSTAL PANEL

(71) Applicant: Shenzhen China Star Optoelectronics Technology Co., Ltd., Shenzhen, Guangdong (CN)

(72) Inventors: Xiaohui Yao, Shenzhen (CN); Cheng-hung Chen, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 217 days.

(21) Appl. No.: 14/232,270

(22) PCT Filed: Jul. 25, 2013

(86) PCT No.: PCT/CN2013/080075

§ 371 (c)(1),
(2) Date: Jan. 12, 2014

(87) PCT Pub. No.: WO2015/006995

PCT Pub. Date: Jan. 22, 2015

(65) Prior Publication Data

US 2015/0022507 A1 Jan. 22, 2015

(30) Foreign Application Priority Data

Jul. 19, 2013 (CN) ..... 2013 1 03068675

(51) Int. Cl.
*G09G 3/36* (2006.01)
*G09G 3/00* (2006.01)

(52) U.S. Cl.
CPC ..... *G09G 3/3659* (2013.01); *G09G 3/003* (2013.01); *G09G 2300/0443* (2013.01); *G09G 2300/0852* (2013.01)

(58) Field of Classification Search
None
See application file for complete search history.

(56) References Cited

U.S. PATENT DOCUMENTS

2013/0100108 A1* 4/2013 Chiang ..... G09G 3/3659 345/212
2014/0035968 A1* 2/2014 Chen ..... G09G 5/02 345/691

* cited by examiner

*Primary Examiner* — Grant Sitta
*Assistant Examiner* — Kirk Hermann
(74) *Attorney, Agent, or Firm* — Andrew C. Cheng

(57) ABSTRACT

An array substrate and a liquid crystal panel area disclosed. Each pixel cell of the array substrate includes a first pixel electrode, a second pixel electrode and a third pixel electrode. In addition, the pixel cell further includes a control circuit for operating on the second pixel electrode to change the voltage of the second pixel electrode. The third pixel electrode connects to the second pixel electrode via a third transistor. In the 2D display mode, the three pixel electrodes are all in the displaying state of corresponding 2D images. In the 3D display mode, the third pixel electrode is in the displaying state of corresponding black images, and the first and the second pixel electrodes are in the displaying state of corresponding 3D images. In this way, the color distortion in the 2D and 3D display modes are enhanced.

20 Claims, 6 Drawing Sheets

ARRAY SUBSTRATE AND THE LIQUID CRYSTAL PANEL

BACKGROUND OF THE INVENTION

1. Field of the Invention

The present disclosure relates to display technology, and more particularly to an array substrate and a liquid crystal panel.

2. Discussion of the Related Art

Vertical Alignment (VA) LCDs are characterized by attributes including quick response time and high contrast, and thus have become a current trend of LCD. However, the alignment and the reflective rate of the liquid crystal are not the same when the viewing angle is different, and thus the transmission rate is low when the squint angle is large. The color displayed at the squint angle and the center view is different, especially in a wide viewing angle. In order to overcome the problem, one pixel is divided into a main-pixel area and a sub-pixel area. Each of the areas is divided to four domains, and thus each of the pixels includes eight domains. By applying different voltage to the main-pixel area and the sub-pixel area, the alignment of the liquid crystal in the two areas are different such that the low color shirt (LCS) effect is achieved.

With the technical evolution, most of the LCDs have 2D and 3D display functions. Regarding the 3D Film-type Patterned Retarder (FPR) technology, pixels arranged in two adjacent rows respectively corresponds to the left eye and the right eye, which generate the signals for left eye image and the right eye image. The left eye image and the right eye image are respectively received by the viewers' left eye and right eye, and then are integrated by viewers' brain to obtain the 3D display performance. The cross talk effect may occur due to the left eye image and the right eye image such that the viewer may observe an overlap image. In order to reduce the cross talk effect, a black matrix (BM) is adopted to reduce the cross talk effect. However, such solution may result in a low aperture rate and a low brightness in the 2D display mode.

By adopting the LCS design, the aperture rate issue and the cross talk issue may be resolved. That is, the main-pixel area and the sub-pixel area display normal 2D images when in the 2D display mode, and when in the 3D display ode, the main-pixel area displays a black image equivalent to the BM and the sub-pixel area displays normal 3D images so as to reduce the cross talk. However, as only the sub-pixel area displays the 3D image in the 3D display mode, the LCS effect cannot be achieved.

SUMMARY

The object of the invention is to provide an array substrate and a liquid crystal panel to reduce the color difference in the 2D and 3D display modes when the viewing angle is large. In addition, the array substrate and the liquid crystal panel not only can increase the aperture rate in the 2D display mode, but can also decrease the cross talk effect in the 3D display mode.

In one aspect, an array substrate include: a plurality of first scanning lines, a plurality of second scanning lines, and a plurality of pixel cells arranged along a row direction, a plurality of data lines, and a common electrode for inputting a common voltage, and each the pixel cells corresponds to one first scanning line, one second scanning line, and one data line; each of the pixel cells includes a first pixel electrode, a second pixel electrode, a third pixel electrode, a first transistor, a second transistor, and a third transistor, each of the pixel cells further includes a control circuit, the first pixel electrode connects to the corresponding first scanning line and the corresponding data line via the first transistor, the second pixel electrode connects to the corresponding first scanning line and the first transistor via the second transistor, the third pixel electrode connects to the corresponding second scanning line and the second pixel electrode via the third transistor, the control circuit respectively connects to the corresponding first scanning lines and the corresponding second pixel electrode of the pixel cell, the control circuit operates on the second pixel electrode when the first scanning lines input scanning signals to change the voltage of the second pixel electrode, and the control circuit controls a voltage difference between the second pixel electrode and the common electrode not equal to zero; in a 2D display mode, the first scanning line inputs the scanning signals to turn on the first transistor and the second transistor, the first pixel electrode receives data signals from the data lines via the first transistor so as to be in a displaying state of corresponding 2D images, the second pixel electrode receives the data signals from the data lines via the first transistor and the second transistor in turn to be in the displaying state of corresponding 2D images, the control circuit operates on the second pixel electrode to change the voltage of the second pixel electrode for the first time, the first scanning lines turns off the first transistor and the second transistor, the second scanning lines inputs the scanning signals to turn on the third transistor such that the second pixel electrode and the third pixel electrode are electrically connected, the third pixel electrode receives the data signals from the second pixel electrode to be in the displaying state of the corresponding 2D images such that the voltage of the second pixel electrode is changed for the second time by the third pixel electrode, the third transistor controls the voltage difference between the second pixel electrode and the third pixel electrode not equal to zero when the third transistor is turn on such that the voltage difference between any two of the first pixel electrode, the second pixel electrode, and the third pixel electrode is not equal to zero, wherein the corresponding first scanning lines of a current pixel-cell row and the corresponding second scanning lines of a previous pixel-cell row are scanned simultaneously, and the previous pixel-cell row is adjacent to the current pixel-cell row and is recently scanned, and in a 3D display mode, the second scanning lines turns off the third transistor, the first scanning line inputs the scanning signals to turn on the first transistor and the second transistor, the first pixel electrode receives the data signals from the data lines via the first transistor to be in the displaying state of corresponding 3D images, the second pixel electrode receives the data signals from the data lines by the first transistor and the second transistor in turn to be in the displaying state of corresponding 3D images, the control circuit operates on the second pixel electrode to change the voltage of the second pixel electrode such that the voltage difference between the first pixel electrode and the second pixel electrode is not equal to zero, and the third pixel electrode is in the displaying state of corresponding black images when the third transistor is turn off.

Wherein the control circuit includes a fourth transistor and a charge sharing capacitor, the fourth transistor includes a control end, a first end and a second end, the control end of the fourth transistor connects to the corresponding first scanning lines of the pixel cell, the first end of the fourth transistor connects to the corresponding second pixel electrode of the pixel cell, the second end of the fourth transistor connects to an end of the charge sharing capacitor, the charge sharing capacitor connects to the common electrode, the first scanning lines inputs the scanning signals to turn on the fourth transistor such that the second pixel electrode and the charge sharing capacitor are electrically connected, the voltage of the second pixel electrode is changed for the first time by the charge sharing capacitor, and the fourth transistor controls the voltage difference between the second pixel electrode and the common electrode not equal to zero.

Wherein the fourth transistor is a thin film transistor (TFT), the control end of the fourth transistor corresponds to a gate of the TFT, the first end of the fourth transistor corresponds to a source of the TFT, the second end of the fourth transistor corresponds to a drain of the TFT, and a width/length ratio of the TFT is smaller than a predetermined value such that the voltage difference between the second pixel electrode and the common electrode is not equal to zero.

Wherein the array substrate further includes a switch unit arranged in a periphery of the array substrate and one shorting line, the switch unit includes a plurality of controlled transistors, the controlled transistor includes a control end, an input end, and an output end, the input ends of each of the controlled transistor connects to the corresponding first scanning lines of the pixel-cell row, the output ends of each of the controlled transistor connects to the corresponding second scanning lines of the previous pixel-cell row, the previous pixel-cell row is adjacent to the current pixel-cell row, and the control ends of the controlled transistors connects to the shorting line; and in the 2D display mode, the shorting line inputs the control signals to turn on all of the controlled transistor, when the corresponding first scanning lines of one pixel-cell row input the scanning signals, the scanning signals are simultaneously input to the second scanning lines connected to the output end of the controlled transistor via the controlled transistor to turn on the third transistor, in the 3D display mode, and the shorting line inputs control signals to turn off all of the controlled transistors so as to turn off all of the third transistors.

In another aspect, an array substrate includes: a plurality of first scanning lines, a plurality of second scanning lines, a plurality of data lines, a plurality of pixel cells, and a common electrode for inputting a common voltage, and each the pixel cells corresponds to one first scanning line, one second scanning line, and one data line; each of the pixel cells includes a first pixel electrode, a second pixel electrode, a third pixel electrode, a first transistor, a second transistor, and a third transistor, each of the pixel cells further includes a control circuit, the first pixel electrode connects to the corresponding first scanning line and the corresponding data line via the first transistor, the second pixel electrode connects to the corresponding first scanning line and the first transistor via the second transistor, the third pixel electrode connects to the corresponding second scanning line and the second pixel electrode via the third transistor, the control circuit respectively connects to the corresponding first scanning lines and the corresponding second pixel electrode of the pixel cell, the control circuit operates on the second pixel electrode when the first scanning lines input scanning signals to change the voltage of the second pixel electrode, and the control circuit controls a voltage difference between the second pixel electrode and the common electrode not equal to zero; in a 2D display mode, the first scanning line inputs the scanning signals to turn on the first transistor and the second transistor, the first pixel electrode receives data signals from the data lines via the first transistor so as to be in a displaying state of corresponding 2D images, the second pixel electrode receives the data signals from the data lines via the first transistor and the second transistor in turn to be in the displaying state of corresponding 2D images, the control circuit operates on the second pixel electrode to change the voltage of the second pixel electrode for the first time, the first scanning lines turns off the first transistor and the second transistor, the second scanning lines inputs the scanning signals to turn on the third transistor such that the second pixel electrode and the third pixel electrode are electrically connected, the third pixel electrode receives the data signals from the second pixel electrode to be in the displaying state of the corresponding 2D images such that the voltage of the second pixel electrode is changed for the second time by the third pixel electrode, the voltage difference between any two of the first pixel electrode, the second pixel electrode, and the third pixel electrode is not equal to zero; and in a 3D display mode, the second scanning lines turns off the third transistor, the first scanning line inputs the scanning signals to turn on the first transistor and the second transistor, the first pixel electrode receives the data signals from the data lines via the first transistor to be in the displaying state of corresponding 3D images, the second pixel electrode receives the data signals from the data lines by the first transistor and the second transistor in turn to be in the displaying state of corresponding 3D images, the control circuit operates on the second pixel electrode to change the voltage of the second pixel electrode such that the voltage difference between the first pixel electrode and the second pixel electrode is not equal to zero, and the third pixel electrode is in the displaying state of corresponding black images when the third transistor is turn off.

Wherein the control circuit includes a fourth transistor and a charge sharing capacitor, the fourth transistor includes a control end, a first end and a second end, the control end of the fourth transistor connects to the corresponding first scanning lines of the pixel cell, the first end of the fourth transistor connects to the corresponding second pixel electrode of the pixel cell, the second end of the fourth transistor connects to an end of the charge sharing capacitor, the charge sharing capacitor connects to the common electrode, the first scanning lines inputs the scanning signals to turn on the fourth transistor such that the second pixel electrode and the charge sharing capacitor are electrically connected, the voltage of the second pixel electrode is changed for the first time by the charge sharing capacitor, and the fourth transistor controls the voltage difference between the second pixel electrode and the common electrode not equal to zero.

Wherein the fourth transistor is a thin film transistor (TFT), the control end of the fourth transistor corresponds to a gate of the TFT, the first end of the fourth transistor corresponds to a source of the TFT, the second end of the fourth transistor corresponds to a drain of the TFT, and a width/length ratio of the TFT is smaller than a predetermined value such that the voltage difference between the second pixel electrode and the common electrode is not equal to zero.

Wherein a plurality of pixel cells, a plurality of the first scanning lines and the plurality of the second scanning lines are arranged along a row direction, in the 2D display mode, the corresponding first scanning lines of a current pixel-cell row and the corresponding second scanning lines of a previous pixel-cell row are scanned simultaneously, and the previous pixel-cell row is adjacent to the current pixel-cell row and is recently scanned.

Wherein the array substrate further includes a switch unit arranged in a periphery of the array substrate and one shorting line, the switch unit includes a plurality of controlled transistors, the controlled transistor includes a control end, an input end, and an output end, the input ends of each of the controlled transistor connects to the corresponding first scanning lines of the pixel-cell row, the output ends of each of the controlled transistor connects to the corresponding second scanning lines of the previous pixel-cell row, the previous pixel-cell row is adjacent to the current pixel-cell row, and the control ends of the controlled transistors connects to the shorting line; and in the 2D display mode, the shorting line inputs the control signals to turn on all of the controlled transistor, when the corresponding first scanning lines of one pixel-cell row input the scanning signals, the scanning signals are simultaneously input to the second scanning lines connected to the output end of the controlled transistor via the controlled transistor to turn on the third transistor, in the 3D display mode, and the shorting line inputs control signals to turn off all of the controlled transistors so as to turn off all of the third transistors.

Wherein a dimension of the area in which the third pixel electrode is located is smaller than that of the areas in which the first pixel electrode and the second pixel electrode are located.

Wherein when the second scanning lines inputs the scanning signals to turn on the third transistor, the third transistor controls the voltage difference between the second pixel electrode and the third pixel electrode not equal to zero when the third transistor is turn on such that the voltage difference between any two of the first pixel electrode, the second pixel electrode, and the third pixel electrode is not equal to zero.

Wherein the third transistor is a TFT, a gate of the TFT connects to the second scanning lines, a source of the TFT connects to the second pixel electrode, a drain of the TFT connects to the third pixel electrode, a width/length of the TFT is smaller than a second predetermined value such that the voltage difference between the second pixel electrode and the third pixel electrode is not equal to zero when the third transistor is turn on.

In another aspect, a liquid crystal panel includes: an array substrate, a color filtering substrate and a liquid crystal layer between the array substrate and the color filtering substrate, the array substrate includes: a plurality of first scanning lines, a plurality of second scanning lines, a plurality of data lines, a plurality of pixel cells, and a common electrode for inputting a common voltage, and each the pixel cells corresponds to one first scanning line, one second scanning line, and one data line; each of the pixel cells includes a first pixel electrode, a second pixel electrode, a third pixel electrode, a first transistor, a second transistor, and a third transistor, each of the pixel cells further includes a control circuit, the first pixel electrode connects to the corresponding first scanning line and the corresponding data line via the first transistor, the second pixel electrode connects to the corresponding first scanning line and the first transistor via the second transistor, the third pixel electrode connects to the corresponding second scanning line and the second pixel electrode via the third transistor, the control circuit respectively connects to the corresponding first scanning lines and the corresponding second pixel electrode of the pixel cell, the control circuit operates on the second pixel electrode when the first scanning lines input scanning signals to change the voltage of the second pixel electrode, and the control circuit controls a voltage difference between the second pixel electrode and the common electrode not equal to zero; in a 2D display mode, the first scanning line inputs the scanning signals to turn on the first transistor and the second transistor, the first pixel electrode receives data signals from the data lines via the first transistor so as to be in a displaying state of corresponding 2D images, the second pixel electrode receives the data signals from the data lines respectively by the first transistor and the second transistor to be in the displaying state of corresponding 2D images, the control circuit operates on the second pixel electrode to change the voltage of the second pixel electrode for the first time, the first scanning lines turns off the first transistor and the second transistor, the second scanning lines inputs the scanning signals to turn on the third transistor such that the second pixel electrode and the third pixel electrode are electrically connected, the third pixel electrode receives the data signals from the second pixel electrode to be in the displaying state of the corresponding 2D images such that the voltage of the second pixel electrode is changed for the second time by the third pixel electrode, the voltage difference between any two of the first pixel electrode, the second pixel electrode, and the third pixel electrode is not equal to zero; and in a 3D display mode, the second scanning lines turns off the third transistor, the first scanning line inputs the scanning signals to turn on the first transistor and the second transistor, the first pixel electrode receives the data signals from the data lines via the first transistor to be in the displaying state of corresponding 3D images, the second pixel electrode receives the data signals from the data lines by the first transistor and the second transistor in turn to be in the displaying state of corresponding 3D images, the control circuit operates on the second pixel electrode to change the voltage of the second pixel electrode such that the voltage difference between the first pixel electrode and the second pixel electrode is not equal to zero, and the third pixel electrode is in the displaying state of corresponding black images when the third transistor is turn off.

Wherein the control circuit includes a fourth transistor and a charge sharing capacitor, the fourth transistor includes a control end, a first end and a second end, the control end of the fourth transistor connects to the corresponding first scanning lines of the pixel cell, the first end of the fourth transistor connects to the corresponding second pixel electrode of the pixel cell, the second end of the fourth transistor connects to an end of the charge sharing capacitor, the charge sharing capacitor connects to the common electrode, the first scanning lines inputs the scanning signals to turn on the fourth transistor such that the second pixel electrode and the charge sharing capacitor are electrically connected, the voltage of the second pixel electrode is changed for the first time by the charge sharing capacitor, and the fourth transistor controls the voltage difference between the second pixel electrode and the common electrode not equal to zero.

Wherein the fourth transistor is a thin film transistor (TFT), the control end of the fourth transistor corresponds to a gate of the TFT, the first end of the fourth transistor corresponds to a source of the TFT, the second end of the fourth transistor corresponds to a drain of the TFT, a width/length ratio of the TFT is smaller than a predetermined value such that the voltage difference between the second pixel electrode and the common electrode is not equal to zero.

Wherein a plurality of pixel cells, a plurality of the first scanning lines and the plurality of the second scanning lines are arranged along a row direction, in the 2D display mode, the corresponding first scanning lines of a current pixel-cell row and the corresponding second scanning lines of a previous pixel-cell row are scanned simultaneously, and the previous pixel-cell row is adjacent to the current pixel-cell row and is recently scanned.

Wherein the array substrate further includes a switch unit arranged in a periphery of the array substrate and one shorting line, the switch unit includes a plurality of controlled transistors, the controlled transistor includes a control end, an input end, and an output end, the input ends of each of the controlled transistor connects to the corresponding first scanning lines of the pixel-cell row, the output ends of each of the controlled transistor connects to the corresponding second scanning lines of the previous pixel-cell row, the previous pixel-cell row is adjacent to the current pixel-cell row, and the control ends of the controlled transistors connects to the shorting line; in the 2D display mode, the shorting line inputs the control signals to turn on all of the controlled transistor, when the corresponding first scanning lines of one pixel-cell row input the scanning signals, the scanning signals are simultaneously input to the second scanning lines connected to the output end of the controlled transistor via the controlled transistor to turn on the third transistor, in the 3D display mode, the shorting line inputs control signals to turn off all of the controlled transistors so as to turn off all of the third transistors.

Wherein a dimension of the area in which the third pixel electrode is located is smaller than that of the areas in which the first pixel electrode and the second pixel electrode are located.

Wherein when the second scanning lines inputs the scanning signals to turn on the third transistor, the third transistor controls the voltage difference between the second pixel electrode and the third pixel electrode not equal to zero when the third transistor is turn on such that the voltage difference between any two of the first pixel electrode, the second pixel electrode, and the third pixel electrode is not equal to zero.

Wherein the third transistor is a TFT, a gate of the TFT connects to the second scanning lines, a source of the TFT connects to the second pixel electrode, a drain of the TFT connects to the third pixel electrode, a width/length of the TFT is smaller than a second predetermined value such that the voltage difference between the second pixel electrode and the third pixel electrode is not equal to zero when the third transistor is turn on.

In view of the above, each pixel cells of the array substrate includes a first pixel electrode, a second pixel electrode, and a third pixel-cell row. The control circuit operates on the second pixel electrode. The third pixel electrode connects to the second pixel electrode via the third transistor. In the 2D display mode, when the first scanning lines inputs the scanning signals, the first pixel electrode receives the data signals from the data line via the first transistor. The second pixel electrode receives the data lines from the data lines via the first transistor and the second transistor in turn so as to be in the displaying state of the corresponding 2D images. The control circuit operates on the second pixel electrode to change the voltage of the second pixel electrode for the first time such that the voltage of the first pixel electrode is different from that of the second pixel electrode. Thus, the color distortion in the wide viewing angle is enhanced. When the first scanning lines stops inputting the scanning signals, the third transistor is turn on such that the second pixel electrode and the third pixel electrode are electrically connected. The third pixel electrode receives the data signals from the second pixel electrode to be in the displaying state of corresponding 2D images. As such, in the 2D display mode, the first, the second, and the third pixel electrode are in the displaying state of corresponding 2D images. Thus, the aperture rate is enhanced. In addition, the voltage of the second pixel electrode is changed for the second time by the third pixel electrode such that the voltage of any two of the three pixel electrodes are different. At the same time, the voltage difference between the second pixel electrode and the first pixel electrode is enlarged, which further reduces the color distortion in the wide viewing angle. In the 3D display mode, the first pixel electrode receives the data signals from the data lines via the first transistor. The second pixel electrode receives the data signals from the data lines via the first and the second transistor in turn to be in the displaying state of corresponding 3D images. The control circuit operates on the second pixel electrode to change the voltage of the second pixel electrode such that the voltage of the first pixel electrode is different from that of the second pixel electrode to reduce the color distortion in wide viewing angle. In addition, in the 3D display mode, the third pixel electrode is controlled to be in the displaying state of corresponding black images so as to reduce the cross talk effect.

DETAILED DESCRIPTION OF THE EMBODIMENTS

Embodiments of the invention will now be described more fully hereinafter with reference to the accompanying drawings, in which embodiments of the invention are shown.

Figure 1:
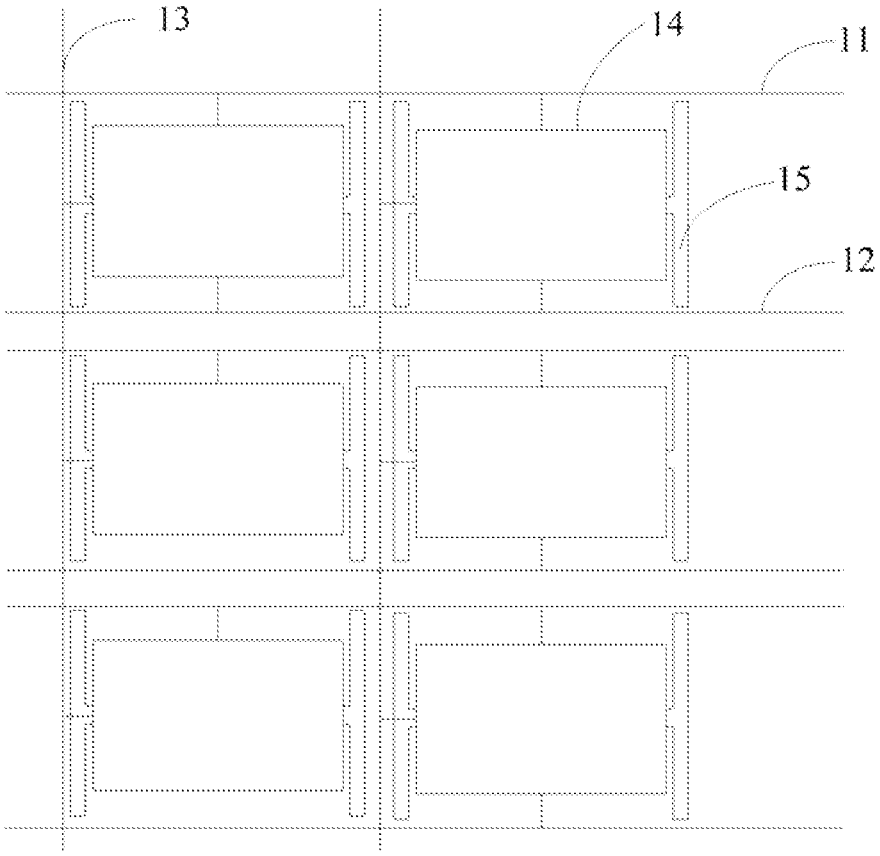
FIG. 1 is a schematic view of the array substrate in accordance with one embodiment.

FIG. 1 is a schematic view of the array substrate in accordance with one embodiment. The array substrate includes a plurality of first scanning lines 11, a plurality of second scanning lines 12, a plurality of data lines 13, a plurality of pixel cells 14 and a common electrode 15 for inputting a common voltage. The pixel cells 14 are arranged in a matrix. Each of the pixel cells 14 connects to one first scanning line 11, one second scanning line 12 and one data line 13.

Figure 2:
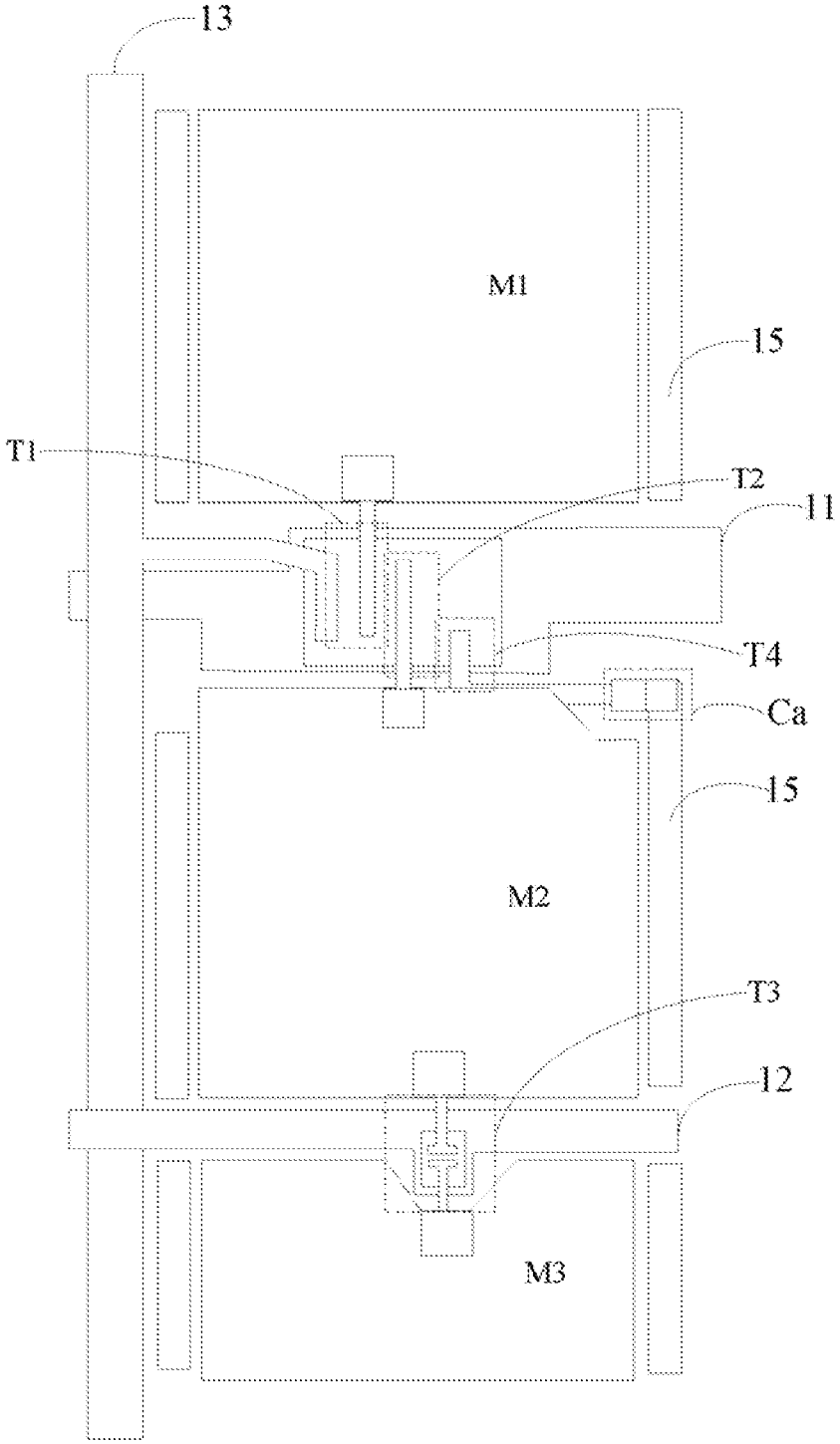
FIG. 2 is a schematic view showing one pixel cell of FIG. 1
Figure 3:
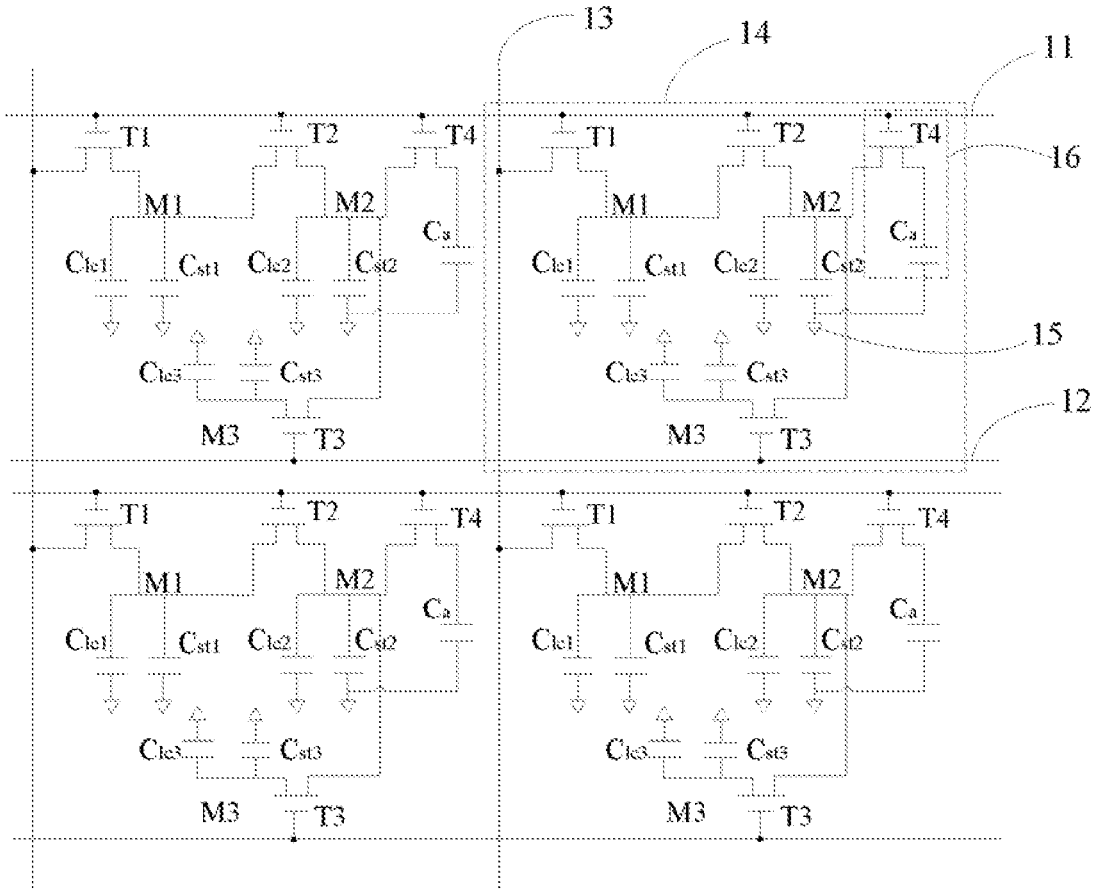
FIG. 3 is an equivalent-circuit diagram of the pixel cell of FIG. 1

Referring to FIGS. 2 and 3, each of the pixel cells 14 includes a first pixel electrode M1, a second pixel electrode M2, a third pixel electrode M3, and a first transistor T1, a second transistor T2, a third transistor T3 respectively corresponding to the first pixel electrode M1, the second pixel electrode M2, and the third pixel electrode M3. Each of the transistors includes a control end, an input end, and an output end. The control ends of the first transistor T1 and the second transistor 12 electrically connect to the corresponding first scanning line 11 of the pixel cell 14. The input end of the first transistor T1 electrically connects to the corresponding data line 13 of the pixel cell 14. The output end of the first transistor T1 electrically connects to the first pixel electrode M1. The input end of the second transistor T2 electrically connects to the first pixel electrode M1. The input end of the second transistor T2 electrically connects to the output end of the first transistor T1. The output end of the second transistor T2 electrically connects to the second pixel electrode M2. The control end of the third transistor T3 electrically connects to the corresponding second scanning line 12 of the pixel cell 14. The input end of the third transistor T3 electrically connects to the second pixel electrode M2. The output end of the third transistor 13 electrically connects to the third pixel electrode M3.

In one embodiment, the first transistor T1, the second transistor T2, and the third transistor T3 are thin film transistors (TFTs). The control ends of the transistors T1, T2, T3 corresponds to the gate of the TFTs. The input ends of the transistors T1, T2, T3 corresponds to the source of the TFTs. The output ends of the transistors T1, T2, T3 corresponds to the drain of the TFTs. In other embodiments, the three transistors may be triode or Darlington transistors.

Each of the pixel cells 14 includes a control circuit 16 connecting to the corresponding first scanning line 11 and second pixel electrode M2 of the pixel cell 14. When the first scanning line 11 inputs scanning signals, the control circuit 16 changes the voltage of the second pixel electrode M2 and controls the voltage difference between the second pixel electrode M2 and the common electrode 15 not equal to zero. Specifically, the control circuit 16 includes a fourth transistor T4 and a charge sharing capacitor Ca. The fourth transistor T4 includes the control end, the input end and the output end. The control end of the fourth transistor T4 electrically connects to the first scanning line 11. A first end of the fourth transistor T4 electrically connects to the second pixel electrode M2. A second end of the fourth transistor T4 electrically connects to one end of the charge sharing capacitor Ca, and the other end of the charge sharing capacitor Ca electrically connects to the common electrode 15. The fourth transistor T4 is the TFT. The control end of the fourth transistor T4 corresponds to the gate of the TFT. The first end of the fourth transistor T4 corresponds to the source of the TFT. The second end of the fourth transistor T4 corresponds to the drain of the TFT. When the fourth transistor T4 is turn on by the scanning signals input from the first scanning line 11, the second pixel electrode M2 and the charge sharing capacitor Ca are electrically connected. The voltage of the second pixel electrode M2 is changed for the reason that the charges are shared among the second pixel electrode M2 and the charge sharing capacitor Ca. In addition, the voltage difference between the second pixel electrode M2 and the common electrode 15 is not equal to zero when the fourth transistor T4 is turn on. As such, the second pixel electrode M2 is in a normal state of displaying images.

The array substrate can reduce the color difference in the 2D and 3D display modes when the viewing angle is large. In addition, the array substrate not only can increase the aperture rate in the 2D display mode, but can also decrease the cross talk effect in the 3D display mode.

Specifically, in the 2D display mode, the first scanning lines 11 and the second scanning lines 12 are scanned in a row-by-row manner. The common electrode 15 inputs the common voltage. When a positive polarity is inversely driven, that is, that data signals is larger than the common voltage, the first scanning line 11 inputs the high-level scanning signals to turn on the first transistor T1 and the second transistor 12. The data line 13 inputs the data signals. The first pixel electrode M1 receives the data signals from the data line 13 via the first transistor T1 so as to be in a displaying state of corresponding 2D images. The second pixel electrode M2 receives the data signals respectively via the first transistor T1 and the second transistor T2 in turn so as to be in the displaying state of corresponding 21D images. At this moment, the voltage of the second pixel electrode M2 is slightly smaller than that of the first pixel electrode M1 due to the resistance of the first transistor T1 and the second transistor T2. As such, the voltage of the first pixel electrode M1 is different from that of the second pixel electrode M2. When the first scanning line 11 inputs the high-level scanning signals, the fourth transistor T4 is turn on in response to a receipt of the scanning signals such that the second pixel electrode M2 and the charge sharing capacitor Ca are electrically connected. The voltage of the second pixel electrode M2 is changed for the first time by the charge sharing capacitor Ca. That is, the second pixel electrode M2 discharges by the charge sharing capacitor Ca. Thus, the voltage of the second pixel electrode M2 is further reduced. In this way, the voltage difference between the first pixel electrode M1 and the second pixel electrode M2 is enlarged.

After being scanned, the first scanning line 11 stops inputting the high-level scanning signals such that the first transistor T1, the second transistor T2 and the fourth transistor T4 are turn off. The second scanning line 12 inputs high-level scanning signals to turn on the third transistor T3. At this moment, the second pixel electrode M2 and the third pixel electrode M3 are electrically connected by the third transistor T3. The third pixel electrode M3 receives the data signals from the second pixel electrode M2 so as to be in the displaying state of corresponding 2D images. In the 2D display mode, the first pixel electrode M1, the second pixel electrode M2, and the third pixel electrode M3 are in the displaying state of corresponding 2D images. Thus, the aperture rate in the 2D display mode is enhanced. In addition, the voltage of the second pixel electrode M2 is changed twice. That is, when the third transistor T3 is turn on, the voltage of the second pixel electrode M2 is changed for the reason that the charges is shared among the second pixel electrode M2 and the liquid crystal capacitance Clc3. The liquid crystal capacitance Clc3 is the equivalent capacitance generated by the liquid crystal arranged between the third pixel electrode M3 and the common electrode of another substrate. Specifically, a portion of the charges of the second pixel electrode M2 is transferred to the third pixel electrode M3 such that the voltage of the second pixel electrode M2 is further reduced until the voltage of the second pixel electrode M2 is the same with that of the third pixel electrode M3. At this moment, the voltage of the first pixel electrode M1 is different from that of the second pixel electrode M2 and third pixel electrode M3 for a certain amount.

When the negative polarity is inverse (the data signals is smaller than the common voltage), the first scanning line 11 inputs the high-level scanning signals to turn on the first transistor T1 and the second transistor T2 and the data line 13 inputs the data signals. The first pixel electrode M1 receives the data signals from the data line 13 via the first transistor T1 so as to be in the displaying state of corresponding 2D images. The second pixel electrode M2 receives the data signals respectively via the first transistor T1 and the second transistor T2 in turn so as to be in the displaying state of corresponding 2D images. At this moment, the voltage of the second pixel electrode M2 is slightly smaller than that of the first pixel electrode M1 due to the resistance of the first transistor T1 and the second transistor T2. As such, the voltage of the first pixel electrode M1 is different from that of the second pixel electrode M2. When the first scanning line 11 inputs the high-level scanning signals, the fourth transistor T4 is turn on in response to a receipt of the scanning signals such that the second pixel electrode M2 and the charge sharing capacitor Ca are electrically connected. The voltage of the second pixel electrode M2 is changed at the first time by the charge sharing capacitor Ca. That is, the second pixel electrode M2 is charged by the charge sharing capacitor Ca. Thus, the voltage of the second pixel electrode M2 is increased for the first time. In this way, the voltage of the first pixel electrode M1 is different from that of the second pixel electrode M2 for a certain value.

After being scanned, the first scanning line 11 stops inputting the high-level scanning signals such that the first transistor T1, the second transistor T2 and the fourth transistor T14 are turn off. The second scanning line 12 inputs high-level scanning signals to turn on the third transistor 13. At this moment, the second pixel electrode M2 and the third pixel electrode M3 are electrically connected by the third transistor T3. As the third pixel electrode M3 preserves the positive polarity of the previous frame, when the third transistor T3 is turn on, the portion of the charges of the third pixel electrode M3 is transferred to the second pixel electrode M2. The voltage of the second pixel electrode M2 is further increased until the voltage of the second pixel electrode M2 is the same with that of the third pixel electrode M3. As the voltage of the first pixel electrode M1 remains the same, the voltage of the first pixel electrode M1 is respectively different from that of the second pixel electrode M2 and the third pixel electrode M3.

Therefore, while the positive polarity or the negative polarity is inverse, the voltage of the second pixel electrode M2 is reduced or increased for the first time during the time frame of the first scanning line 11 due to the fourth transistor T4 and the charge sharing capacitor Ca. The voltage of the second pixel electrode M2 is reduced or increased for the second time during the time frame of the second scanning lines 12 due to the charges sharing of the third pixel electrode M3. As such, the voltage difference between the second pixel electrode M2 and the common electrode 15 is reduced. At the same time, the voltage difference between the second pixel electrode M2 and the first pixel electrode M1 is increased. Also, the voltage difference between the third pixel electrode M3 and the first pixel electrode M1 is increased. In this way, in the 2D display mode, the color distortion in wide viewing angle is enhanced.

In addition, the voltage difference between the second pixel electrode M2 and the common electrode 15 is reduced when the fourth transistor T4 is turn on. To ensure the second pixel electrode M2 can be in the normally displaying state the fourth transistor T4 controls the voltage difference between the second pixel electrode M2 and the common electrode 15 not equal to zero when the fourth transistor T4 is turn on. That is, the voltage of the second pixel electrode M2 is not equal to the voltage of the common electrode 15. Specifically, the turn-on time of the fourth transistor T4 equals to the time period for which the first scanning line 11 inputs the scanning signals. When the positive polarity is inverse, the second pixel electrode M2 only releases a portion of the charges toward the charge sharing capacitor Ca when the fourth transistor T4 is turn on. The voltage of the second pixel electrode M2 is reduced before the voltage of the second pixel electrode M2 is equal to the voltage of the common electrode 15. When the negative polarity is inverse, the charge sharing capacitor Ca only releases the portion of the charges toward the second pixel electrode M2. The voltage of the second pixel electrode M2 is increased before the voltage of the second pixel electrode M2 is equal to the common electrode 15 such that the second pixel electrode M2 is in the normally displaying state. Furthermore, the current amount of the fourth transistor T4 is configured when the fourth transistor T4 is turn on such that the transfer speed of the charges between the second pixel electrode M2 and the charge sharing capacitor Ca is controlled. The current amount relates to the current amount that is allowed to pass through when the fourth transistor T4 is turn on. For example, to ensure the voltage of the second pixel electrode M2 is not the same with that of the common electrode 15 when the fourth transistor T4 is turn on, the charges transfer speed between the second pixel electrode M2 and the charge sharing capacitor Ca is configured to slow down. In the embodiment, the fourth transistor T4 is a TFT. When the TFT is turn on, the current amount of the TFT relates to the width/length ratio of the TFT. The smaller width/length ratio of the TFT relates to the smaller current amount of the TFT, and vice versa. Thus, by configuring the width/length ratio of the fourth transistor T4 to be smaller than a first predetermined value, the current amount of the fourth transistor T4 is smaller than one predetermined value. Thus, the speed of the charge transfer between the second pixel electrode M2 and the charge sharing capacitor Ca is also smaller than one predetermined value when the fourth transistor T4 is turn on. As such, the voltage difference between the second pixel electrode M2 and the common electrode 15 is not equal to zero. The first predetermined value is configured according to real scenarios. For example, the first predetermined value may be 0.3 or other values as long as the voltage difference between the second pixel electrode M2 and the common electrode 15 is not equal to zero, and the charges can be shared among the second pixel electrode M2 and the charge sharing capacitor Ca when the fourth transistor T4 is turn on. It is to be noted that if the first predetermined value is too small, the current amount of the fourth transistor T4 may be zero, which results in that the voltage of the second pixel electrode M2 cannot be changed.

In other embodiments, the current amount of the fourth transistor T4 is configured by controlling the voltage of the gate of the fourth transistor T4. The current amount is positively related to the voltage of the gate, and vice versa. In addition, the fourth transistor T4 may be, but not limited to, a triode.

After completing the scanning process of the corresponding first scanning lines 11 and the second scanning line 12 of a current pixel-cell 14 row, the corresponding first scanning lines 11 and the second scanning line 12 of the next pixel-cell row begin the scanning process.

Figure 4:
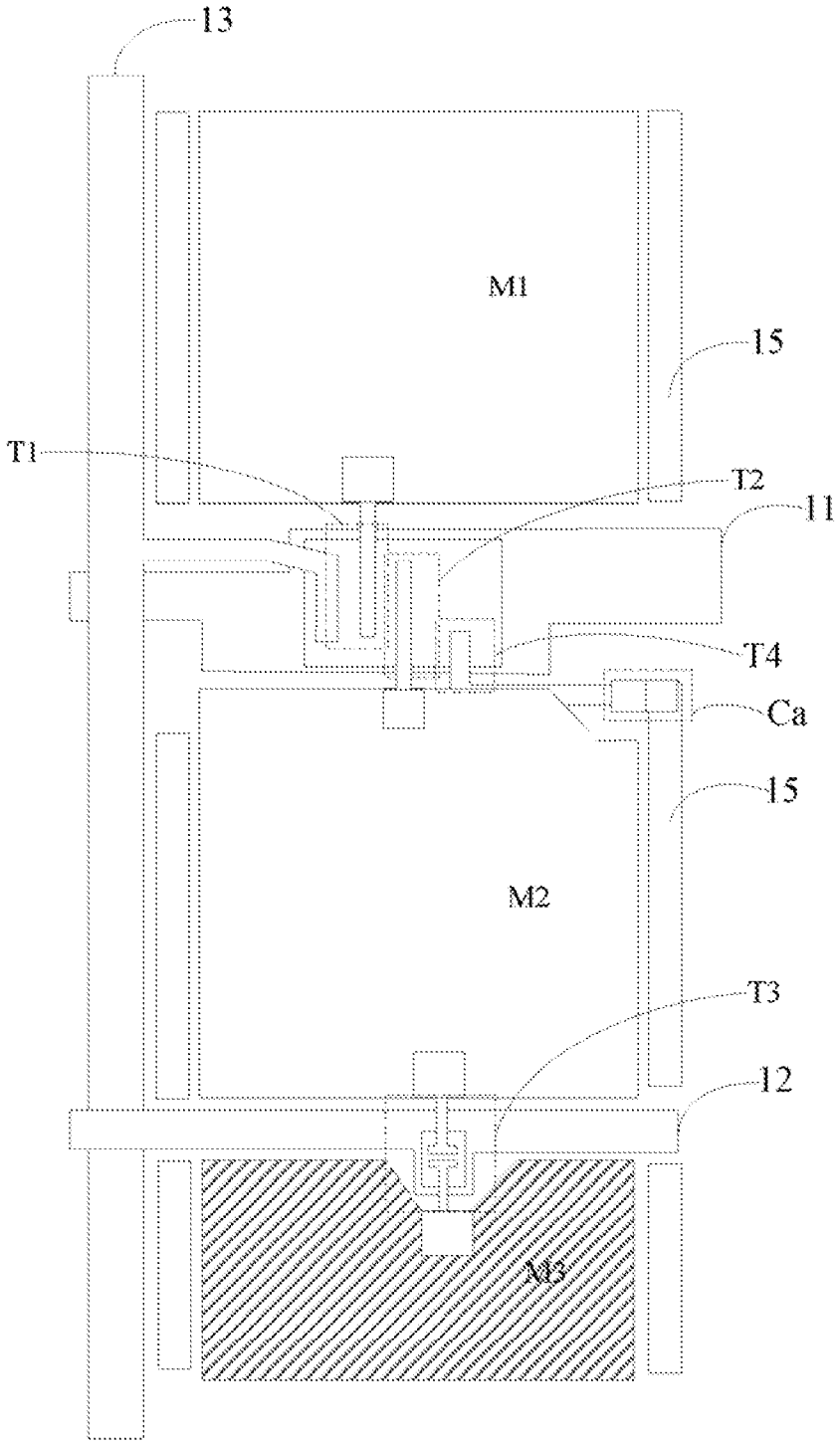
FIG. 4 is a schematic view showing the display effect of the third pixel electrode of the pixel cell of FIG. 1 in 3D display mode.

Referring to FIG. 4, in the 3D display mode, firstly, the black images turns off the third pixel electrode M3. That is, the data line 13 input the data signals corresponding to the black images to the first pixel electrode M1 and the second pixel electrode M2. Afterward, the third transistor T3 is turn on and thus the third pixel electrode M3 is in the displaying state of corresponding black images. That is, the third pixel electrode M3 is turn off. The first scanning line 11 inputs high-level scanning signals to turn on the first transistor T1 and the second transistor T2, and the data line 13 inputs the data signals to the first pixel electrode M1 by the first transistor T1 such that the first pixel electrode M1 is in the displaying state of corresponding 3D images. The second pixel electrode M2 receives the data signals via the first transistor T1 and the second transistor T2 in turn so as to be in the displaying state of corresponding 3D images. At this moment, the voltage of the second pixel electrode M2 is slightly smaller than that of the first pixel electrode M1 due to the resistance of the first transistor T1 and the second transistor T2. As such, the voltage of the first pixel electrode M1 is different from that of the second pixel electrode M2. When the first scanning line 11 inputs the high-level scanning signals, the fourth transistor T4 is turn on in response to a receipt of the scanning signals such that the second pixel electrode M2 and the charge sharing capacitor Ca are electrically connected. The voltage of the second pixel electrode M2 is changed for the first time by the charge sharing capacitor Ca. That is, when the positive polarity is inverse, the second pixel electrode M2 discharges via the charge sharing capacitor Ca resulting in a lower voltage. When the negative polarity is inverse, the second pixel electrode M2 charges by via the charge sharing capacitor Ca resulting in a higher voltage. As such, the voltage of the second pixel electrode M2 is different from that of the first pixel electrode M1 for a certain value. In this way, the color distortion in the 3D display mode is enhanced. To ensure the second pixel electrode M2 can be in the displaying state of corresponding 3D images, the fourth transistor T4 controls the voltage difference between the second pixel electrode M2 and the common electrode 15 not equal to zero when the fourth transistor T4 is turn on. In addition, in the 3D display mode, the second scanning line 12 is turn off. That is, the scanning signals is not input to the second scanning lines 12 such that the third transistor T3 is in an off-state. Thus, the third pixel electrode M3 is in the displaying state of corresponding black images.

In the embodiment, the first pixel electrode M1, the second pixel electrode M2 and the third pixel electrode M3 are arranged along the row direction. Two pixel cells 14 arranged in adjacent rows respectively displays the corresponding left eye image and the right eye image of the 3D images. As shown in FIG. 4, the third transistor T3 is turn off such that the third pixel electrode M3 is in the displaying state of the black images, which is equivalent to a black matrix (BM) between the pixel-cell rows 14 arranged in adjacent rows. The BM is arranged between the second pixel electrode M2 and the third pixel electrode M3 of the current pixel-cell row, which is for displaying the left eye image, and the second pixel electrode M2 and the third pixel electrode M3 of a next pixel-cell row; which is for displaying the right eye image. The BM blocks the cross talk signals of the left eye image and the right eye image so reduced the cross talk effect in the 3D display mode. In one embodiment, the dimension of the third pixel electrode M3 is smaller than that of the first pixel electrode M1 and the second pixel electrode M2. In other embodiments, the dimension of the third pixel electrode M3 is configurable.

The array substrate not only increases the aperture rate in the 2D display mode, but also achieves a low color shift in the 2D and 3D display mode. In addition, the cross talk effect is also reduced in the 3D display mode.

In other embodiments, the three pixel electrodes may be arranged along a column direction, and the two adjacent pixel cells arranged along the column direction respectively displays the left eye image and the right eye image of the 3D images. Similarly, the third pixel electrode for displaying corresponding black images is arranged to reduce to cross talk effect in the 3D display mode. In other embodiments, a black insertion method can be adopted within a blanking time of the first scanning line to maintain the third pixel electrode M3 in the displaying state of the black images. Within a scanning time frame, the first pixel electrode and the second pixel electrode are controlled to be in the displaying state of corresponding 3D images, and the third pixel electrode M3 is controlled to be in the displaying state of corresponding black images. In the next scanning time frame, all of the pixel electrodes are in the displaying state of corresponding black images. Afterward, the first pixel electrode, the second pixel electrode, and the second pixel electrode are in the displaying state of corresponding 3D images. In brief, the first pixel electrode and the second pixel electrode alternately display the corresponding 3D images and the black images. The above black insertion method can prevent the second pixel electrode from leaking electricity and the light leakage.

In other embodiments, the control circuit includes a divider resistor and a transistor. The second pixel electrode M2 connects to the divider resistor via triggering the transistor. When the transistor is triggered by the scanning signals form the first scanning line, the voltage of the second pixel electrode M2 is changed by the divider resistor. By configuring the resistance of the divider resistor, the changed amount of the second pixel electrode M2 can be configured. The above solution changes the voltage of the second pixel electrode M2 to ensure a certain voltage difference exists between the first pixel electrode M1 and the second pixel electrode M2 so as to achieve the low color shift effect. In one embodiment, the control circuit only includes the divider resistor. The second pixel electrode M2 directly connects to the divider resistor such that the voltage of the second pixel electrode M2 is changed by the divider resistor.

In the above embodiments, the third transistor T3 is a normal TFT. The voltage of the second pixel electrode M2 is the same with that of the third pixel electrode M3 in the end when the third transistor T3 is turn on. Thus, a certain voltage difference exists between the second pixel electrode M2, third pixel electrode M3 and the first pixel electrode M1 so as to achieve the low color shift effect. In other embodiments, the third transistor T3 is configured such that the voltage of the second pixel electrode M2 is different from that of the third pixel electrode M3. In this way, a certain voltage difference exists between the first pixel electrode M1, second pixel electrode M2, and third pixel electrode M3. Specifically, when the second scanning line inputs the scanning signals to turn on the third switch, the voltage difference between the second pixel electrode M2 and the third pixel electrode M3 is not zero when the third switch is turn on. As such, the second pixel electrode M2 and the third pixel electrode M3 would not be in a discharging balance state, that is, the voltage of the second pixel electrode M2 is different from that of the third pixel electrode M3. In this way, the voltage of any two of the first pixel electrode M1, second pixel electrode M2, and the third pixel electrode M3 are different. Thus, the color distortion in the 2D display mode is reduced in the wide viewing angle.

In one embodiment, a width/length ratio of the third transistor T3 is configured to control the voltage different between the second pixel electrode M2 and the third pixel electrode M3 when the third transistor T3 is turn on. That is, the width/length ratio of the third transistor T3 is configured to control a current amount of the third transistor T3. The greater width/length ratio of the third pixel electrode M3 relates to the greater current amount and a faster speed of charges transfer between the second pixel electrode M2 and the third pixel electrode M3. To ensure the voltage of the second pixel electrode M2 is not the same with that of the third pixel electrode M3 when the third transistor 13 is turn on, the charges transfer speed between the second pixel electrode M2 and the third pixel electrode M3 is configured to slow down, and thus the width/length ratio of the third transistor T3 is smaller than a predetermined value, i.e., 0.2. Under the circumstance, the voltage difference between the second pixel electrode M2 and the third pixel electrode M3 is not zero when the third transistor T3 is turn on. In other embodiments, the current amount of the third transistor T3 is configured by controlling the voltage of the gate of the third transistor T3, for example, controlling the scanning signals input from the second scanning line 12.

Figure 5:
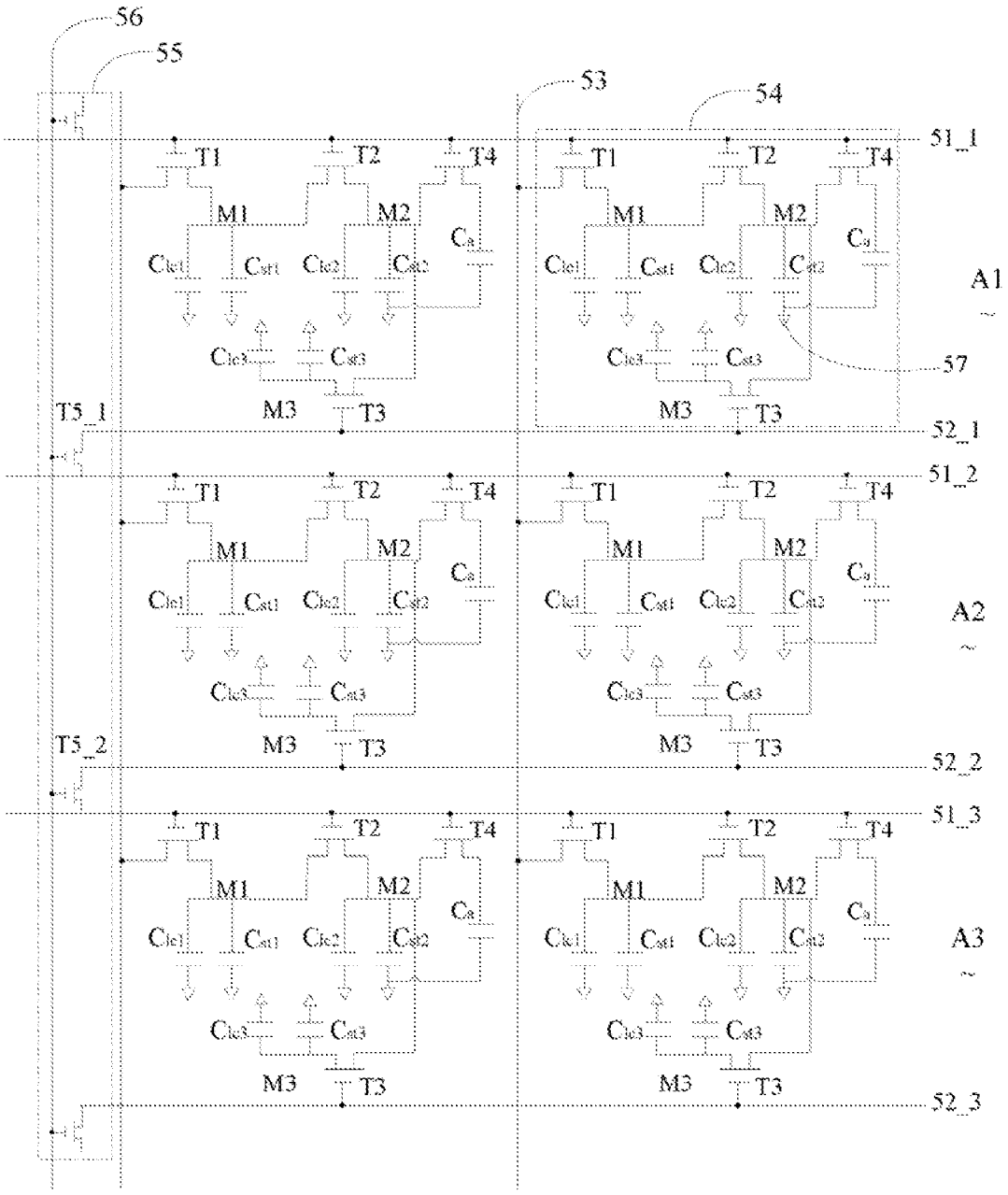
FIG. 5 is an equivalent-circuit diagram of the pixel cell in accordance with another embodiment.

In the above embodiments, in the 2D display mode, the first and the second scanning lines are scanned in the row-by-row basis. FIG. 5 shows the array substrate in accordance with another embodiment. In the embodiments, a plurality of corresponding first and the second scanning lines of the pixel cells are scanned simultaneously. Three of the first scanning lines (51_1、51_2、51_3) and three of the second scanning lines are taken as examples, which shows the scanning lines are arranged along the row direction. In the 2D display mode, the first pixel-cell row A1 and the second pixel-cell row A2 are taken as the example to illustrate. Upon scanning the corresponding first scanning line (51_2) of the second pixel-cell row A2, the corresponding second scanning line (52_1) of the adjacent pixel-cell row that is recently scanned, i.e., the first pixel-cell row A1, is also scanned simultaneously.

In one embodiment, the array substrate also includes a switch unit 55 arranged in a periphery of the array substrate and one shorting line 56. The switch unit 55 includes a plurality of controlled transistors, including controlled transistors (T5_1, T5_2). The controlled transistor includes a control end, an input end and an output end. The controlled transistor (T5_1) between the first pixel-cell row A1 and second pixel-cell row A2 is taken as one example. The input end of the controlled transistor (T5_1) connects to the first scanning line (51_2) of the second pixel-cell row A2, the output end of the controlled transistor (T5_1) connects to the second scanning line (52_1), and the control ends of all of the controlled transistors connect to the shorting line 56. In one embodiment, the controlled transistors are thin film transistors (TFT). The control end of the controlled transistor corresponds to a gate of the TFT, the input end of the controlled transistor corresponds to a source of the TFr, and the output end of the controlled transistor corresponds to a drain of the TFT In the 2D display mode, the shorting line 56 inputs high-level control signals to turn on all of the controlled transistors, and then the first scanning lines are scanned in the row-by-row basis. First, the corresponding first scanning line (51_1) of the first pixel-cell row A1 inputs the scanning signals to turn on the first transistor T1 and the t2 and the second transistor T2 of the first pixel-cell row A1. The data line 53 inputs the data signals such that the first pixel electrode M1 and the second pixel electrode M2 are in the displaying state of corresponding 2D images. The fourth transistor T4 is turn on when the first scanning line (51_1) inputs the scanning signals such that the second pixel electrode M2 and the charge sharing capacitor Ca are electrically connected. The voltage of the second pixel electrode M2 is changed for the first time due to the charges sharing among the second pixel electrode M2 and the charge sharing capacitor Ca. The voltage of the first pixel electrode M1 is different from that of the second pixel electrode M2 for a certain amount. In this way, in the 2D display mode, the color distortion in wide viewing angle is enhanced.

When the corresponding first scanning lines (51_1) of the first pixel-cell row A1 are scanned, the corresponding scanning lines (51_2) of the second pixel-cell row A2 input the scanning signals to turn on the first transistor T1, the second transistor T2, and the fourth transistor T4 corresponding to the second pixel-cell row A2. At this moment, the controlled transistor (T5_1) is turn on, and the scanning signals from the corresponding first scanning line (51_2) of the second pixel-cell row A2 are input to the corresponding second scanning line (52_1) of the first pixel-cell row A1 via the controlled transistor (T5_1) so as to turn on the third transistor T3 of the first pixel-cell row A1. As such, the second pixel electrode M2 and the third pixel electrode M3 are electrically connected, and the third pixel electrode M3 of the first pixel-cell row A1 is in the displaying state of the corresponding 2D images so as to increase the aperture rate. In addition, the voltage of the second pixel electrode M2 of the first pixel-cell row A1 is changed due to the third pixel electrode M3 such that the voltage difference between the second pixel electrode M2 and the third pixel electrode M3 of the first pixel-cell row A1 and the first pixel electrode is enlarged, which achieves the low color shift effect. After the corresponding first scanning line (51_2) of the second pixel-cell row A2 has been scanned, the scanning process of the corresponding first scanning line (51_3) of the third pixel-cell row A3 begins. At the same time, the controlled transistor (T5_2) controls the corresponding second scanning line (52_2) of the second pixel-cell row A2 to be scanned simultaneously. It is to be noted that the scanning process are similarly performed for all of the other scanning lines.

In the 3D display mode, the shorting line 56 inputs the control signals to turn off the controlled transistors. The scanning signals are input to the first scanning line 51_1 to turn on the first transistor T1 and the second transistor T2 of the first pixel-cell row A1. The data line 53 inputs the data signals such that the first pixel electrode M1 and the second pixel electrode M2 of the first pixel-cell row A1 are in the displaying state of the corresponding 3D images. The fourth transistor T4 is turn on when the first scanning line (51_1) inputs the scanning signals such that the voltage of the second pixel electrode M2 is changed for the first time. The voltage of the first pixel electrode M1 is different from that of the second pixel electrode M2. In this way, in the 3D display mode, the color distortion in wide viewing angle is enhanced.

Afterward, the scanning signals are input to the corresponding first scanning line (51_2) of the second pixel-cell row A2 to turn on the first transistor T1, the second transistor T2 and the fourth transistor T4. As the controlled transistor (T5_1) is turn off, and thus the scanning signals input from the first scanning line (51_2) would not enter the third transistor T3 of the first pixel-cell row A1 such that the third transistor T3 is turn off. As such, the third pixel electrode M3 of the first pixel-cell row A1 is in the displaying state of the corresponding black image to reduce the cross talk effect in the 3D display mode. After the corresponding first scanning line (51_2) of the second pixel-cell row A2 has been scanned, the scanning process of the corresponding first scanning line of the next pixel-cell row begins until all of the first scanning lines are scanned. It is to be noted that the controlled transistors in the switch unit 55 are all in the off state all the time in the 3D display mode such that the second scanning lines is also in the off state.

In view of the above, only one scanning driven chip is needed to apply the control signals to the shorting line 56 to turn on or off the controlled transistors in the switch unit 55. As such, the third transistor T3 is controlled to be turn on or off. In this way, not only the low color shift effect and a higher aperture rate can be achieved in the 2D display mode, but also the cross talk effect can be reduced in the 3D display mode. Furthermore, the number of the scanning driven chips can also be reduced, and so does the cost. On the other hand, two scanning lines can be scanned within the same scanning time frame such that the scanning time of each of the scanning line is prolonged, which contributes to a higher refresh rate.

In other embodiments, the first scanning lines and the second scanning lines corresponding to different pixel-cell rows can be scanned simultaneously without adopting the switch unit 55 and the shorting line 56 (55). Each of the scanning lines, including the first scanning lines and the second scanning lines, is independent from each other. Each of the scanning lines connects to one scanning drive chip. When the scanning signals are input to the corresponding scanning lines of a current pixel-cell row, the scanning signals are also input to the corresponding second scanning lines of the previous pixel-cell row. In this way, the scanning lines corresponding to different pixel-cell rows can be scanned simultaneously.

Figure 6:
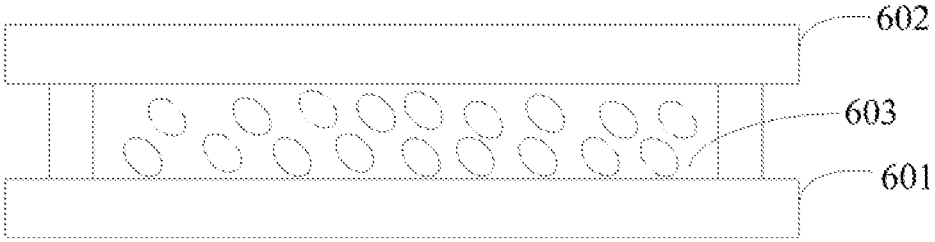
FIG. 6 is a schematic view of the liquid crystal panel in accordance with one embodiment.

FIG. 6 is a schematic view of the liquid crystal panel in accordance with one embodiment. The liquid crystal panel includes the array substrate 601, a color filtering substrate 602, and a liquid crystal layer 603 between the array substrate 601 and the color filtering substrate 602. The array substrate is one of the above-mentioned array substrate.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An array substrate, comprising: a plurality of first scanning lines, a plurality of second scanning lines, and a plurality of pixel cells arranged along a row direction, a plurality of data lines, and a common electrode for inputting a common voltage, and each of the pixel cells corresponds to one first scanning line, one second scanning line, and one data line; each of the pixel cells comprises a first pixel electrode, a second pixel electrode, a third pixel electrode, a first transistor, a second transistor, and a third transistor, each of the pixel cells further comprises a control circuit, the first pixel electrode connects to the corresponding first scanning line and the corresponding data line via the first transistor, the second pixel electrode connects to the corresponding first scanning line and the first transistor via the second transistor, the third pixel electrode connects to the corresponding second scanning line and the second pixel electrode via the third transistor, the control circuit respectively connects to the corresponding first scanning lines and the corresponding second pixel electrode of the pixel cell, the control circuit operates on the second pixel electrode when the first scanning lines input scanning signals to change the voltage of the second pixel electrode, and the control circuit controls a voltage difference between the second pixel electrode and the common electrode not equal to zero;

in a 2D display mode, the first scanning line inputs the scanning signals to turn on the first transistor and the second transistor, the first pixel electrode receives data signals from the data lines via the first transistor so as to be in a displaying state of corresponding 2D images, the second pixel electrode receives the data signals from the data lines via the first transistor and the second transistor in turn to be in the displaying state of corresponding 2D images, the control circuit operates on the second pixel electrode to change the voltage of the second pixel electrode for the first time, the first scanning lines turns off the first transistor and the second transistor; the second scanning lines inputs the scanning signals to turn on the third transistor such that the second pixel electrode and the third pixel electrode are electrically connected, the third pixel electrode receives the data signals from the second pixel electrode to be in the displaying state of the corresponding 2D images such that the voltage of the second pixel electrode is changed for the second time by the third pixel electrode, the third transistor controls the voltage difference between the second pixel electrode and the third pixel electrode not equal to zero when the third transistor is turn on such that the voltage difference between any two of the first pixel electrode, the second pixel electrode, and the third pixel electrode is not equal to zero, wherein the corresponding first scanning lines of a current pixel-cell row and the corresponding second scanning lines of a previous pixel-cell row are scanned simultaneously, and the previous pixel-cell row is adjacent to the current pixel-cell row and is recently scanned; and in a 3D display mode, the second scanning lines turns off the third transistor, the first scanning line inputs the scanning signals to turn on the first transistor and the second transistor, the first pixel electrode receives the data signals from the data lines via the first transistor to be in the displaying state of corresponding 3D images, the second pixel electrode receives the data signals from the data lines by the first transistor and the second transistor in turn to be in the displaying state of corresponding 3D images, the control circuit operates on the second pixel electrode to change the voltage of the second pixel electrode such that the voltage difference between the first pixel electrode and the second pixel electrode is not equal to zero, and the third pixel electrode is in the displaying state of corresponding black images when the third transistor is turn off.

2. The array substrate as claimed in claim 1, wherein the control circuit includes a fourth transistor and a charge sharing capacitor, the fourth transistor comprises a control end, a first end and a second end, the control end of the fourth transistor connects to the corresponding first scanning lines of the pixel cell, the first end of the fourth transistor connects to the corresponding second pixel electrode of the pixel cell, the second end of the fourth transistor connects to an end of the charge sharing capacitor, the charge sharing capacitor connects to the common electrode, the first scanning lines input the scanning signals to turn on the fourth transistor such that the second pixel electrode and the charge sharing capacitor are electrically connected, the voltage of the second pixel electrode is changed for the first time by the charge sharing capacitor, and the fourth transistor controls the voltage difference between the second pixel electrode and the common electrode not equal to zero.

3. The array substrate as claimed in claim 2, wherein the fourth transistor is a thin film transistor (TFT), the control end of the fourth transistor corresponds to a gate of the TFT, the first end of the fourth transistor corresponds to a source of the TFT, the second end of the fourth transistor corresponds to a drain of the TFT, and a width/length ratio of the TFT is smaller than a predetermined value such that the voltage difference between the second pixel electrode and the common electrode is not equal to zero.

4. The array substrate as claimed in claim 1, wherein the array substrate further comprises a switch unit arranged in a periphery of the array substrate and one shorting line, the switch unit comprises a plurality of controlled transistors, the controlled transistor comprises a control end, an input end, and an output end, the input ends of each of the controlled transistor connects to the corresponding first scanning lines of the pixel-cell row, the output ends of each of the controlled transistor connects to the corresponding second scanning lines of the previous pixel-cell row, the previous pixel-cell row is adjacent to the current pixel-cell row, and the control ends of the controlled transistors connect to the shorting line; and in the 2D display mode, the shorting line inputs the control signals to turn on all of the controlled transistor, when the corresponding first scanning lines of one pixel-cell row input the scanning signals, the scanning signals are simultaneously input to the second scanning lines connected to the output end of the controlled transistor via the controlled transistor to turn on the third transistor, in the 3D display mode, and the shorting line inputs control signals to turn off all of the controlled transistors so as to turn off all of the third transistors.

5. An array substrate, comprising: a plurality of first scanning lines, a plurality of second scanning lines, a plurality of data lines, a plurality of pixel cells, and a common electrode for inputting a common voltage, and each of the pixel cells corresponds to one first scanning line, one second scanning line, and one data line;

each of the pixel cells comprises a first pixel electrode, a second pixel electrode, a third pixel electrode, a first transistor, a second transistor, and a third transistor, each of the pixel cells further comprises a control circuit, the first pixel electrode connects to the corresponding first scanning line and the corresponding data line via the first transistor, the second pixel electrode connects to the corresponding first scanning line and the first transistor via the second transistor, the third pixel electrode connects to the corresponding second scanning line and the second pixel electrode via the third transistor, the control circuit respectively connects to the corresponding first scanning lines and the corresponding second pixel electrode of the pixel cell, the control circuit operates on the second pixel electrode when the first scanning lines input scanning signals to change the voltage of the second pixel electrode, and the control circuit controls a voltage difference between the second pixel electrode and the common electrode not equal to zero;

in a 2D display mode, the first scanning line inputs the signals to turn on the first transistor and the second transistor, the first pixel electrode receives data signals from the data lines via the first transistor so as to be in a displaying state of corresponding 2D images, the second pixel electrode receives the data signals from the data lines via the first transistor and the second transistor in turn to be in the displaying state of corresponding 2D images, the control circuit operates on the second pixel electrode to change the voltage of the second pixel electrode for the first time, the first scanning lines turns off the first transistor and the second transistor, the second scanning lines inputs the scanning signals to turn on the third transistor such that the second pixel electrode and the third pixel electrode are electrically connected, the third pixel electrode receives the data signals from the second pixel electrode to be in the displaying state of the corresponding 2D images such that the voltage of the second pixel electrode is changed for the second time by the third pixel electrode, the voltage difference between any two of the first pixel electrode, the second pixel electrode, and the third pixel electrode is not equal to zero; and in a 3D display mode, the second scanning lines turns off the third transistor, the first scanning line input the scanning signals to turn on the first transistor and the second transistor, the first pixel electrode receives the data signals from the data lines via the first transistor to be in the displaying state of corresponding 3D images, the second pixel electrode receives the data signals from the data lines by the first transistor and the second transistor in turn to be in the displaying state of corresponding 3D images, the: control circuit operates on the second pixel electrode to change the voltage of the second pixel electrode such that the voltage difference between the first pixel electrode and the second pixel electrode is not equal to zero, and the third pixel electrode is in the displaying state of corresponding black images when the third transistor is turn off.

6. The array substrate as claimed in claim 5, whereto the control circuit includes a fourth transistor and a charge sharing capacitor, the fourth transistor comprises a control end, first end and a second end, the control end of the fourth transistor connects to the corresponding first scanning lines of the pixel cell, the first end of the fourth transistor connects to the corresponding second pixel electrode of the pixel cell, the second end of the fourth transistor connects to an end of the charge sharing capacitor; the charge sharing capacitor connects to the common electrode, the first scanning lines inputs the scanning signals to turn on the fourth transistor such that the second pixel electrode and the charge sharing capacitor are electrically connected, the voltage of the second pixel electrode is changed for the first time by the charge sharing capacitor, and the fourth transistor controls the voltage difference between the second pixel electrode and the common electrode not equal to zero.

7. The array substrate as claimed in claim 6, wherein the fourth transistor is a thin film transistor (TFT), the control end of the fourth transistor corresponds to a gate of the TFT, the first end of the fourth transistor corresponds to a source of the TFT, the second end of the fourth transistor corresponds to a drain of the TFT, and a width/length ratio of the TFT is smaller than a predetermined value such that the voltage difference between the second pixel electrode and the common electrode is not equal to zero.

8. The array substrate as claimed in claim 5, wherein a plurality of pixel cells, a plurality of the first scanning lines and the plurality of the second scanning lines are arranged along a row direction, in the 2D display mode, the corresponding first scanning lines of a current pixel-cell row and the corresponding second scanning lines of a previous pixel-cell row are scanned simultaneously, and the previous pixel-cell row is adjacent to the current pixel-cell row and is recently scanned.

9. The array substrate as claimed in claim 8, wherein the array substrate: further comprises a switch unit arranged in a periphery of the array substrate and one shorting line, the switch unit comprises a plurality of controlled transistors, the controlled transistor comprises a control end, an input end, and an output end, the input ends of each of the controlled transistor connects to the corresponding first scanning lines of the pixel-cell row, the output ends of each of the controlled transistor connects to the corresponding second scanning lines of the previous pixel-cell row; the previous pixel-cell row is adjacent to the current pixel-cell row and the control ends of the controlled transistors connects to the shorting line; and in the 2D display mode, the shorting line inputs the control signals to turn on all of the controlled transistor, when the corresponding first scanning lines of one pixel-cell row input, the scanning signals, the scanning signals are simultaneously input to the second scanning lines connected to the output end of the controlled transistor via the controlled transistor to turn on the third transistor; in the 3D display mode, and the shorting line inputs control signals to turn off all of the controlled transistors so as to turn off all of the third transistors.

10. The array substrate as claimed in claim 5, wherein a dimension of the area in which the third pixel electrode is located is smaller than that of the areas in which the first pixel electrode and the second pixel electrode are located.

11. The array substrate as claimed in claim 5, wherein when the second scanning lines inputs the scanning signals to turn on the third transistor, the third transistor controls the voltage difference between the second pixel electrode and the third pixel electrode not equal to zero when the third transistor is turn on such that the voltage difference between any two of the first pixel electrode, the second pixel electrode, and the third pixel electrode is not equal to zero.

12. The array substrate as claimed in claim 11, wherein the third transistor is a TFT, a gate of the TFT connects to the second scanning lines, a source of the TFT connects to the second pixel electrode, a drain of the TFT connects to the third pixel electrode, a width/length of the TFT is smaller than a second predetermined value such that the voltage difference between the second pixel electrode and the third pixel electrode is not equal to zero when the third transistor is turn on.

13. A liquid crystal panel, comprising: an array substrate, a color filtering substrate and a liquid crystal layer between the array substrate and the color filtering substrate, the array substrate comprises: a plurality of first scanning lines, a plurality of second scanning lines, a plurality of lines, a plurality of pixel cells, and a common electrode for inputting a common voltage, and each of the pixel cells corresponds one first scanning line, one second scanning line, and one data line; each of the pixel cells comprises a first pixel electrode, a second pixel electrode, a third pixel electrode, a first transistor, a second transistor, and a third transistor, each of the pixel cells further comprises a control circuit, the first pixel electrode connects to the corresponding first scanning line and the corresponding data line via the first transistor, the second pixel electrode connects to the corresponding first scanning line and the first transistor via the second transistor, the third pixel electrode connects to the corresponding second scanning line and the second pixel electrode via the third transistor, the control circuit respectively connects to the corresponding first scanning lines and the corresponding second pixel electrode of the pixel cell, the control circuit operates on the second pixel electrode when the first scanning lines input scanning signals to change the voltage of the second pixel electrode, and the control circuit controls a voltage difference between the second pixel electrode and the common electrode not equal to zero;

in a 2D display mode, the first scanning line inputs the scanning signals to turn on the first transistor and the second transistor; the first pixel electrode receives data signals from the data lines via the first transistor so as to be in a displaying state of corresponding 2D images, the second pixel electrode receives the data signals from the dam lines respectively by the first transistor and the second transistor to be in the displaying state of corresponding 2D images, the control circuit operates on the second pixel electrode to change the voltage of the second pixel electrode for the first time, the first scanning lines turns off the first transistor and the second transistor, the second scanning lines inputs the scanning signals to turn on the third transistor such that the second pixel electrode and the third pixel electrode are electrically connected, the third pixel electrode receives the data signals from the second pixel electrode to be in the displaying state of the corresponding 2D images such that the voltage of the second pixel electrode is changed for the second time by the third pixel electrode, the voltage difference between any two of the first pixel electrode, the second pixel electrode, and the third pixel electrode is not equal to zero; and in a 3D display mode, the second scanning lines turns off the third transistor, the first scanning line inputs the scanning signals to turn on the first transistor and the second transistor, the first pixel electrode receives the data signals from the data lines via the first transistor to be in the displaying state of corresponding 3D images, the second pixel electrode receives the data signals from the data lines by the first transistor and the second transistor in turn to be in the displaying state of corresponding 3D images, the: control circuit operates on the second pixel electrode to change the voltage of the second pixel electrode such that the voltage difference between the first pixel electrode and the second pixel electrode is not equal to zero, and the third pixel electrode is in the displaying state of corresponding black images when the third transistor is turn off.

14. The liquid crystal panel as claimed in claim 13, whereto the control circuit includes a fourth transistor and a charge sharing capacitor, the fourth transistor comprises a control end, a first end and a second end, the control end of the fourth transistor connects to the corresponding first scanning lines of the pixel cell, the first end of the fourth transistor connects to the corresponding second pixel electrode of the pixel cell, the second end of the fourth transistor connects to an end of the charge sharing capacitor, the charge sharing capacitor connects to the common electrode, the first scanning lines inputs the scanning signals to turn on the fourth transistor such that the second pixel electrode and the charge sharing capacitor are electrically connected, the voltage of the second pixel electrode is changed for the first time by the charge sharing capacitor, and the fourth transistor controls the voltage difference between the second pixel electrode and the: common electrode not equal to zero.

15. The liquid crystal panel as claimed in claim 14, wherein the fourth transistor is a thin film transistor (TFT), the control end of the fourth transistor corresponds to a gate of the TFT, the first end of the fourth transistor corresponds to a source of the TFT, the second end of the fourth transistor corresponds to a drain of the TFT, a width/length ratio of the TFT is smaller than a predetermined value such that the voltage difference between the second pixel electrode and the common electrode is not equal to zero.

16. The liquid crystal panel as claimed in claim 13, wherein a plurality of pixel cells, a plurality of the first scanning lines and the plurality, of the second scanning lines are arranged along a row direction, in the 2D display mode, the corresponding first scanning lines of a current pixel-cell row and the corresponding second scanning lines of a previous pixel-cell row are scanned simultaneously, and the previous pixel-cell row is adjacent to the current pixel-cell row and is recently scanned.

17. The liquid crystal panel as claimed in claim 16, wherein the array substrate further comprises a switch unit arranged in a periphery of the array substrate and one shorting line, the switch unit comprises a plurality of controlled transistors, the controlled transistor comprises a control end, an input end, and an output end, the input ends of each of the controlled transistor connects to the corresponding first scanning lines of the pixel-cell row, the output ends of each of the controlled transistor connects to the corresponding second scanning lines of the previous pixel-cell row, the previous pixel-cell row is adjacent to the current pixel-cell row, and the control ends of the controlled transistors connects to the shorting line;

in the: 2D display mode, the shorting line inputs the control signals to turn on all of the controlled transistor, when the corresponding first scanning lines of one pixel-cell row input the scanning signals, the scanning signals are simultaneously input to the second scanning lines connected to the output end of the controlled transistor via the controlled transistor to turn on the third transistor, in the 3D display mode, the shorting line inputs control signals to turn off all of the controlled transistors so as to turn off all of the third transistors.

18. The liquid crystal panel as claimed in claim 13, wherein a dimension of the area in which the third pixel electrode is located is smaller than that of the areas in which the first pixel electrode and the second pixel electrode are located.

19. The liquid crystal panel as claimed in claim 13, wherein when the second scanning lines inputs the scanning signals to turn on the third transistor, the third transistor controls the voltage difference between the second pixel electrode and the third pixel electrode not equal to zero when the third transistor is turn on such that the voltage difference between any two of the first pixel electrode, the second pixel electrode, and the third pixel electrode is not equal to zero.

20. The liquid crystal panel as claimed in claim 19, wherein the third transistor is a TFT, a gate of the TFT connects m the second scanning lines, a source of the TFT connects to the second pixel electrode, a drain of the TFT connects to the third pixel electrode, a width/length of the TFT is smaller than a second predetermined value such that the voltage difference between the second pixel electrode and the third pixel electrode is not equal to zero when the third transistor is turn on.

* * * * *